US006945673B2

(12) United States Patent
Yao

(10) Patent No.: US 6,945,673 B2
(45) Date of Patent: Sep. 20, 2005

(54) DECORATIVE ILLUMINATIONS

(76) Inventor: Yihong Yao, Gubang Illumination Company Ltd., Huaide Administrative District, Humen Town, Dongguan City, Guangdong Province (CN), 523920

( * ) Notice: Subject to any disclaimer, the term of this patent is extended or adjusted under 35 U.S.C. 154(b) by 89 days.

(21) Appl. No.: 10/637,650

(22) Filed: Aug. 11, 2003

(65) Prior Publication Data

US 2004/0252523 A1 Dec. 16, 2004

(30) Foreign Application Priority Data

Jun. 10, 2003 (CN) ..... 03247081 U

(51) Int. Cl.[7] ..... F21S 13/14

(52) U.S. Cl. ..... 362/252; 362/565; 362/806; 362/122

(58) Field of Search ..... 362/252, 568, 362/565, 566, 567, 806, 227, 234, 235, 121, 122, 605, 253

(56) References Cited

U.S. PATENT DOCUMENTS 1,980,708 A * 11/1934 Sxel ..... 362/121
3,731,081 A * 5/1973 Yellin ..... 362/249
4,164,008 A * 8/1979 Miller et al. ..... 362/252
5,077,646 A * 12/1991 Parsons ..... 362/252
5,555,163 A * 9/1996 Pisani ..... 362/252
5,769,533 A * 6/1998 Yamuro et al. ..... 362/252
6,027,228 A * 2/2000 Adams et al. ..... 362/252
6,561,674 B2 * 5/2003 Gibboney, Jr. ..... 362/253

* cited by examiner

*Primary Examiner*—John Anthony Ward
*Assistant Examiner*—Bao Q. Truong
(74) *Attorney, Agent, or Firm*—Global IP Services

(57) ABSTRACT

A decorative illumination includes an illumination string and a baseplate. The baseplate is provided with laser film. The illumination string fits inside a lamphole, and the lamphole is a through hole that penetrates the baseplate and laser film. The baseplate is made form plastic film material. In addition, there is a support frame on the other side of the laser film opposite to the base plate, and the illumination string is inside the support frame and fitted in the lamphole. The illuminations in accordance with the present invention provide advantages of simple structure and aesthetic appearance that can beautify the environment and provide perfect night lighting effect, which can be used for decoration, beautifying the environment, etc.

8 Claims, 2 Drawing Sheets

DECORATIVE ILLUMINATIONS

CROSS-REFERENCES TO RELATED APPLICATIONS

This application is related to and claims priority to Chinese Application No. 03247081.9, filed Jun. 10, 2003, incorporated herein by reference in its entirety.

BACKGROUND OF THE INVENTION

1. Field of the Technology

The present invention relates to a kind of illumination, especially relates to a kind of illumination with vignette.

2. Description of Related Technology

At present, decorative patterns used in public and entertainment places are not brilliant at night. Although lamps can be used for lighting, the results are not good enough.

SUMMARY OF THE INVENTION

One aspect of the present utility model is to provide a kind of illumination with simple structure and aesthetic appearance that can beautify the environment and achieve perfect night illumination effects.

According to one embodiment, an illumination includes an illumination string and a baseplate, wherein the baseplate is provided with a laser film. The illumination string fits inside a lamphole, and the lamphole is, e.g., a through hole that penetrates the baseplate and the laser film.

According to another embodiment, an illumination includes an illumination string and a baseplate, wherein the baseplate is provided with a laser film. The illumination string fits inside a lamphole, and the lamphole is a through hole that penetrates the baseplate and the film. The baseplate is made from plastic film material. In addition, a support frame may be provided on the other side of the laser film opposite to the baseplate, and the illumination string may be inside the support frame and fitted in the lamphole.

The plan patterns on the support frame can be floral decoration, animal pattern, insect pattern, geometrical design, Christmas decoration, Holloween pattern, and so on, which are splendid in appearance.

The laser film on the baseplate is preferred to be multicolored laser films that are pasted up.

The present invention provides advantages of simple structure and aesthetic appearance, which can beautify the environment, provide perfect night lighting effect, and move everywhere at will, etc.

DETAILED DESCRIPTION OF PREFERRED EMBODIMENTS

Figure 1:
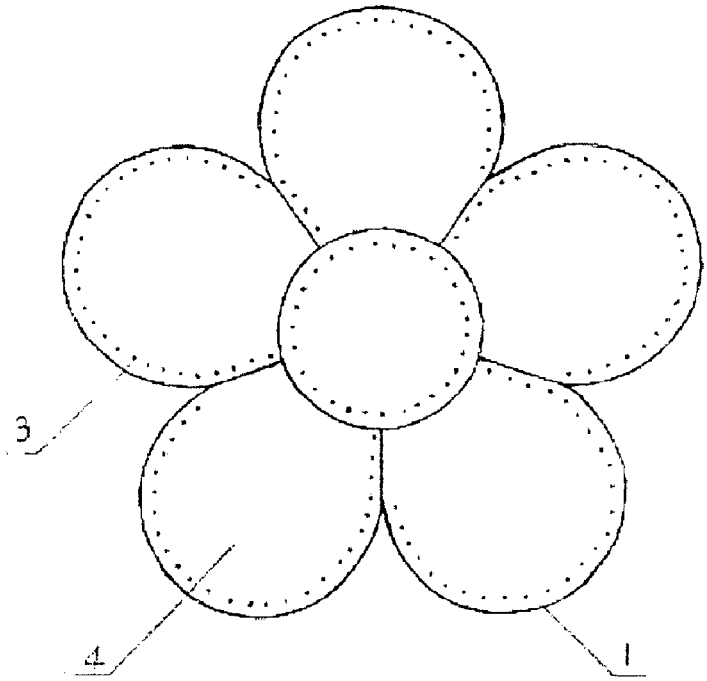
FIG. 1 is a front view of a first embodiment of the present invention.

The present invention is description in details below in conjunction with preferred embodiments thereof, referring to the attached drawings. The embodiment includes a support frame 1, baseplate 2, illumination string 3, laser film 4 and lamphole 5.

Figure 2:
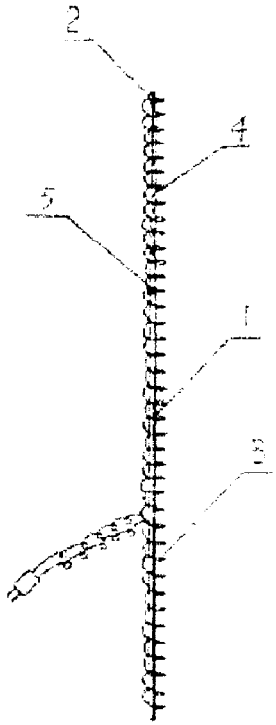
FIG. 2 is a side view of FIG. 1.

Refer to FIGS. 1 and 2, a decorative illumination in accordance with a first embodiment comprises a lighted decoration in the form of a floral pattern. The illumination includes support frame 1, baseplate 2, a string of illuminations 3, laser film 4, lamphole 5 and power cord. Support frame 1 is a frame made of metal wire that forms the floral pattern. Baseplate 2 has the same shape of floral decoration as in support frame 1, which is fixed onto support frame 1. Laser film 4 on baseplate 2 is fitted with illumination string 3. In addition there are laser film 4 and illuminations string hole 5. All illuminations are connected together by power cord in the back.

Figure 3:
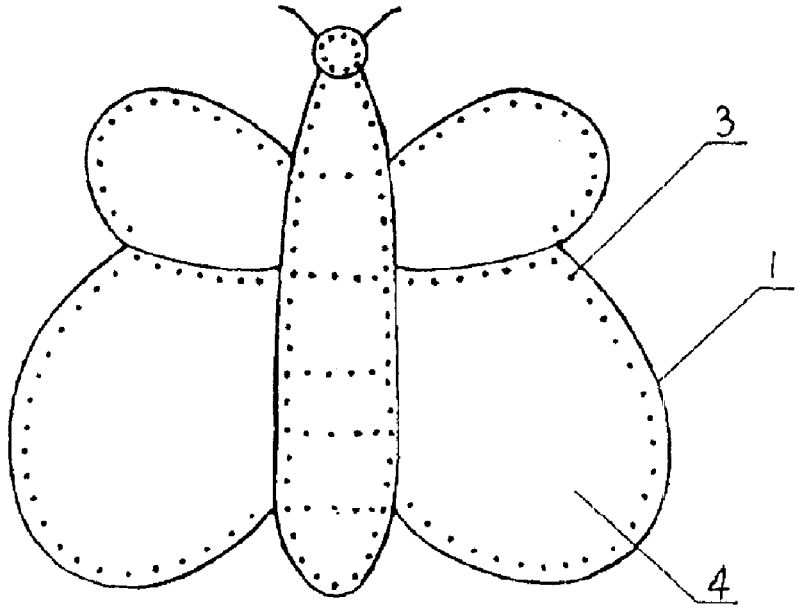
FIG. 3 is a front view of a second embodiment of the present invention.
Figure 4:
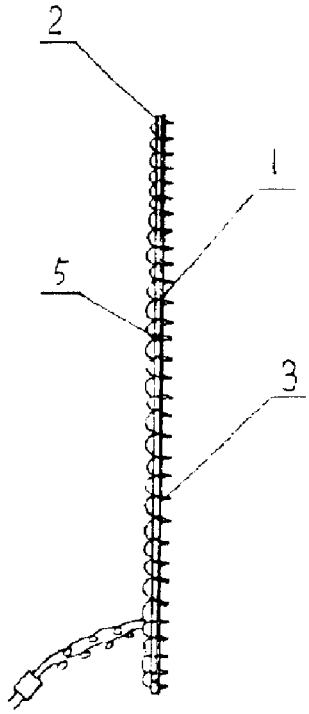
FIG. 4 is a side view of FIG. 3.

Refer to FIGS. 3 and 4, a decorative illumination in accordance with a second embodiment comprises a lighted decoration in the form of a butterfly diagram. The illumination includes support frame 1, baseplate 2, a string of illuminations 3 and power cord. Support frame 1 is a frame made of metal wire that forms the butterfly pattern. Baseplate 2 has the same butterfly shape as in support frame 1, which is fixed onto support frame 1. Laser film 4 on baseplate 2 is fitted with illumination string 3. All illuminations are connected together by power cord in the back.

Using the present embodiments, plugging in the illumination string will cause it to light, and decoration illuminations will present vignettes. Power supply may also be in the form of a battery. Because laser film 4 possesses very strong reflecting effect, perfect decorative effect is achieved at night.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the disclosure.

What is claimed is:

1. A decorative illumination, comprising an illuminations string and a baseplate, said baseplate including a laser film, wherein the illuminations string fits inside a lamphole, and said lamphole is a through hole that penetrates the baseplate and the laser film, wherein the baseplate is made from plastic film material, and a support frame on the other side of the laser film opposite to the base-plate, and the illuminations string is inside the support frame and fitted in the lamphole.

2. The illumination as described in claim 1, wherein the support frame has a pattern-shape, and illuminations of said illuminations string are configured according to the pattern shape on the support frame.

3. A The illumination as described in claim 1, wherein a plan pattern on the support frame comprises an animal pattern.

4. The illumination as described in claim 1, wherein a plan pattern on the support frame comprises an insect pattern.

5. The illumination as described in claim 1, wherein a plan pattern on the support frame comprises a geometrical design.

6. The illumination as described in claim 1, wherein the laser film on the baseplate comprises pasted up multicolored laser films.

7. The illumination as described in claim 1, wherein a plan pattern on the support frame comprises a Christmas decoration.

8. The illumination as described in claim 1, wherein a plan pattern on the support frame comprises a Holloween pattern.

* * * * *